United States Patent [19]

Rascov

[11] Patent Number: 4,957,419

[45] Date of Patent: Sep. 18, 1990

[54] COMPRESSOR

[76] Inventor: Anthony J. Rascov, 4304 Tobasco Rd., Cincinnati, Ohio 45244

[21] Appl. No.: 337,937

[22] Filed: Apr. 14, 1989

[51] Int. Cl.[5] ..... F04B 1/00

[52] U.S. Cl. ..... 417/273

[58] Field of Search ..... 417/273, 460, 567

[56] References Cited

U.S. PATENT DOCUMENTS 4,788,944 12/1988 Rascov .

*Primary Examiner*—Gerald A. Michalsky

*Attorney, Agent, or Firm*—Frost & Jacobs

[57] ABSTRACT

A piston compressor. First and second manifold plates are joined together with their inner surfaces in fluid-tight abutment. First and second cylinder housings are affixed to the outer surfaces of the first and second manifold plates, respectively, in fluid tight fashion and oriented at 90° with respect to each other. Each cylinder housing contains first and second opposed, fixed piston rod/piston head assemblies, each extending axially from an end of its respective cylinder housing. Each cylinder housing contains an elongated sleeve having an axial bore at each end receiving one of the piston heads in sealing engagement and defining therewith a compression chamber. A crank comprising a crank element and oppositely directed crank pins having its crank element located in a central hole in the manifold plates and its crank pins each mounted in bearings in a central transverse hole in one of the sleeves. As the crank is rotated the crank element has an essentric motion so that each crank pin rotates about its own axis and simultaneously reciprocates rectalinearly causing its respective sleeve to reciprocate in its respective cylinder housing. The crank is driven by connection of one of its crank pins to an input shaft through a power transfer assembly. Ambient or low pressure fluid is introduced into each compression chamber by manifold passages and at least one one-way valve in the piston head. Pressurized fluid exists each compression chamber through a one-way valve and passages formed in the piston rod/piston head and in the manifold plates.

8 Claims, 4 Drawing Sheets

COMPRESSOR

TECHNICAL FIELD

The invention relates to a compressor, and more particularly to a sleeve actuated, four piston compressor characterized by simplified construction and low energy requirements.

BACKGROUND ART

While the capacity of the compressor of the present invention is largely based upon the compressor sleeves and the length of their travel, for purposes of an exemplary showing, the compressor will be described and illustrated in its form as a relatively light duty compressor as might be used in an automotive air conditioning system or the like. The use to which the compressor is put is not a limitation of the invention. The compressor can be used in a closed system as would be found in an air conditioning system or refrigeration system, or it could be used to compress ambient air for a paint spraying system, a pneumatically actuated tool such as a nailer or stapler, or the like.

The compressor of the present invention is of unique construction comprising a pair of cylinder chambers mounted to either side of a manifold. Each cylinder chamber contains a pair of axially aligned, opposed, fixed piston heads and a reciprocating sleeve element having axial bores forming compression chambers with each piston. The cylinder housings are oriented at ninety degrees with respect to each other and the sleeves therein are caused to reciprocate by a crank comprising a crank element located in a central hole in the manifold and a pair of oppositely directed crank pins, each engaged in bearing means in transverse holes in one of the sleeves. Rotation of the crank is such that each crank pin rotates about its own axis and simultaneously reciprocates along a rectilinear path of travel. One end of one of the crank pins is connected through an appropriate universal means to a rotating power shaft to drive the compressor.

U.S. Pat. No. 4,788,944 teaches an internal combustion engine having cylinder housings oriented at 90° with respect to each other. This reference suggests that the internal combustion engine could be modified to act as a compressor. However, the reference does not teach such modification and the structure of the internal combustion engine differs markedly from that of the compressor taught herein.

Most light duty compressors are complex in construction, requiring many machined parts made of expensive materials. In addition, prior art compressors are relatively bulky and heavy, and have high energy requirements.

The present invention overcomes each of these problems. From the description to follow, it will be noted that the compressor of the present invention is extremely simple in construction and very compact. While the various parts and pieces of the compressor can be made of metal or the like, substantially all of the parts of the unit can be made of appropriate plastic materials except for the ball spring valves, the crank, the bearings and the like. Finally, the compressor of the present invention is characterized by low energy requirements. This makes it particularly suitable for applications such as automotive air conditioning systems, wherein it will cause less drop in engine power when compressor is operating. This would be of significance today since the trend is to provide automobiles with smaller engines.

DISCLOSURE OF THE INVENTION

According to the invention there is provided a compressor comprising first and second manifold plates. The manifold plates have inner and outer surfaces and are joined together with their inner surfaces abutting in fluid-tight fashion. A first cylinder housing is affixed in fluid-tight fashion to the outer surface of the first manifold plate and a second cylinder housing is affixed in fluid-tight fashion to the outer surface of the second manifold plate. The cylinder housings are substantially identical and extend across their respective manifold plates in directions oriented at ninety degrees with respect to each other. Each cylinder housing contains first and second piston rod/piston head assemblies. The first and second piston rod/piston head assemblies of each cylinder housing are opposed, extending axially from each end of their respective cylinder housing, and each assembly is fixed with respect to the cylinder housing end from which it extends.

Each of the first and second cylinder housings contains an elongated sleeve; each sleeve has axial bores extending inwardly from each of its ends. Each axial sleeve bore contains one of the piston heads of its respective cylinder housing. Each piston head is in fluid-tight sealing engagement with its respective bore. Each sleeve bore and the forward face of the piston head therein define a compression chamber, there being two such compression chambers within each cylinder housing.

The sleeves are interconnected by a crank comprising a crank element located in a central hole in the manifold plates and oppositely directed crank pins, each mounted in bearings in a central transverse hole in one of the sleeves, located between the sleeve bores. As the crank is rotated, the crank element has an eccentric motion such that each crank pin rotates about its own axis and simultaneously reciprocates rectilinearly, causing its respective sleeve to reciprocate in its respective cylinder housing. The crank is driven by connection of one of its pins to a power transfer assembly. The power transfer assembly in turn, is driven directly or indirectly by an appropriate prime mover.

A series of passages formed in the manifold plates connects the compressor intake for ambient or low pressure gas to each cylinder housing behind each piston head therein. The ambient or low pressure gas is drawn into each compression chamber during the intake stroke of the sleeve for that chamber through at least one opening in the piston head for that chamber, provided with a one-way valve. Pressurized gas from each compression chamber exits that chamber during a compression stroke of the sleeve for that chamber through a central opening in the piston head for that chamber, provided with a one-way valve. The central opening of the piston head is connected through a passage in the piston rod and through passages in the manifold to the high pressure outlet of the compressor.

That crank pin not connected to the power transfer assembly, may be utilized to drive a pump to circulate oil through the compressor, when such oil circulation is required.

DETAILED DESCRIPTION OF THE INVENTION

Figure 1:
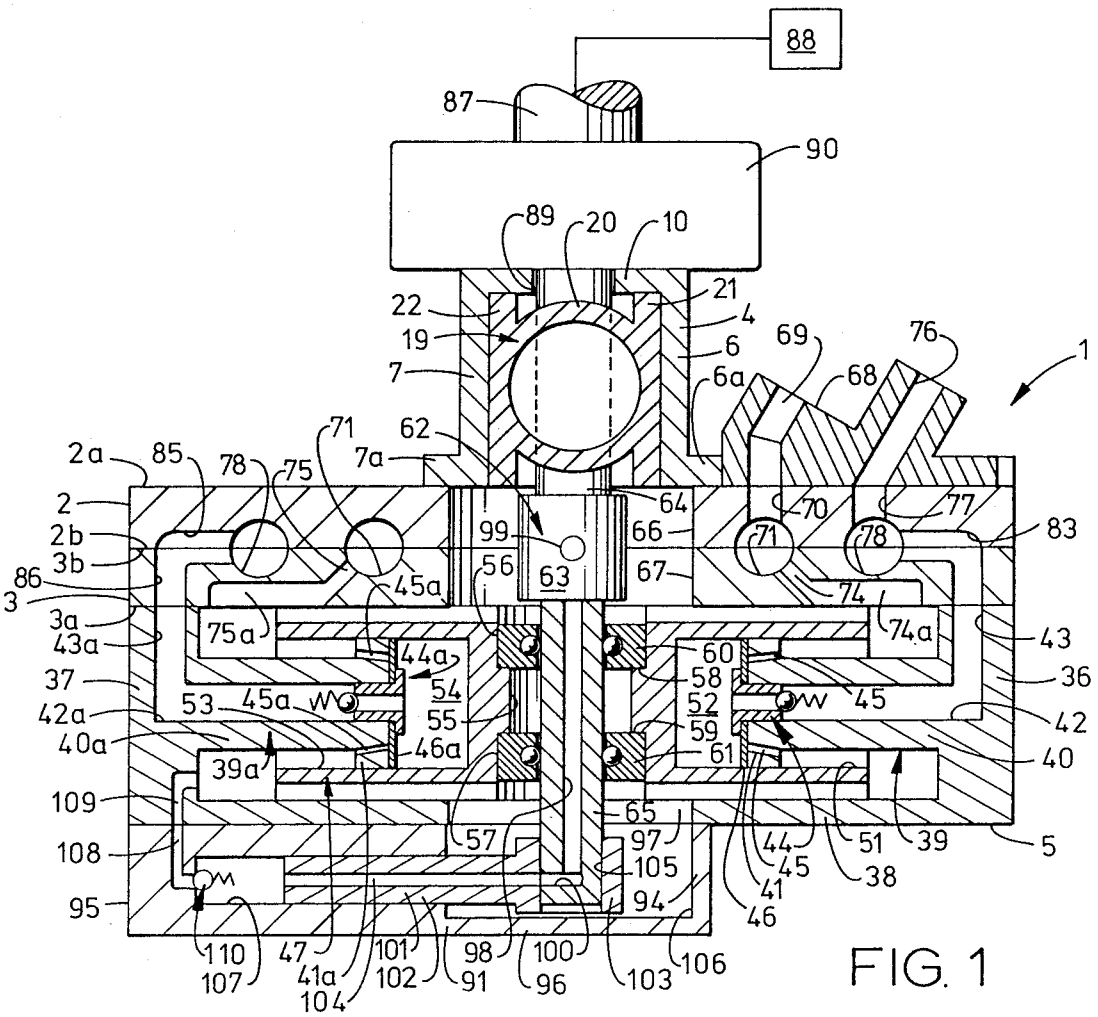
FIG. 1 is a fragmentary cross-sectional view of the compressor of the present invention, taken along the center line of the second cylinder housing.

In all of the figures, like parts have been given like index numerals. The compressor of the present invention is generally indicated at 1. The compressor 1 comprises a pair of manifold plates 2 and 3. Manifold plate 2 has an outer surface 2*a* and an inner surface 2*b*. Similarly, manifold plate 3 has an outer surface 3*a* and an inner surface 3*b*. The manifold plates 2 and 3 are joined together with their inner surfaces 2*b* and 3*b* in fluid-tight, abutting relationship. The purpose of manifold plates 2 and 3 will be described hereinafter. While not a necessary limitation of the invention, for purposes of an exemplary showing, manifold plates 2 and 3 are illustrated as being of circular configuration (see FIG. 2).

A first cylinder housing 4 is mounted on the outer surface of the first manifold plate 2. A second cylinder housing 5 is mounted on the outer surface 3*a* of the second manifold plate 3. The first cylinder housing 4 has longitudinal side walls 6 and 7, end walls 8 and 9 and an outer wall 10. If desired, the longitudinal side walls can be provided with laterally extending flanges 6*a* and 7*a*. As is most clearly shown in FIGS. 1 and 2, cylinder housing 4 is affixed to manifold plate 2 so as to extend diametrically thereof. Cylinder housing 4 can be affixed to manifold plate 2 in any suitable fluid-tight manner, as for example by welding, or by bolts and appropriate gasket means (not shown). If the manifold plate 2 and cylinder housing 4 are made of appropriate plastic material, the cylinder housing 4 could be glued to manifold plate 2.

Figure 2:
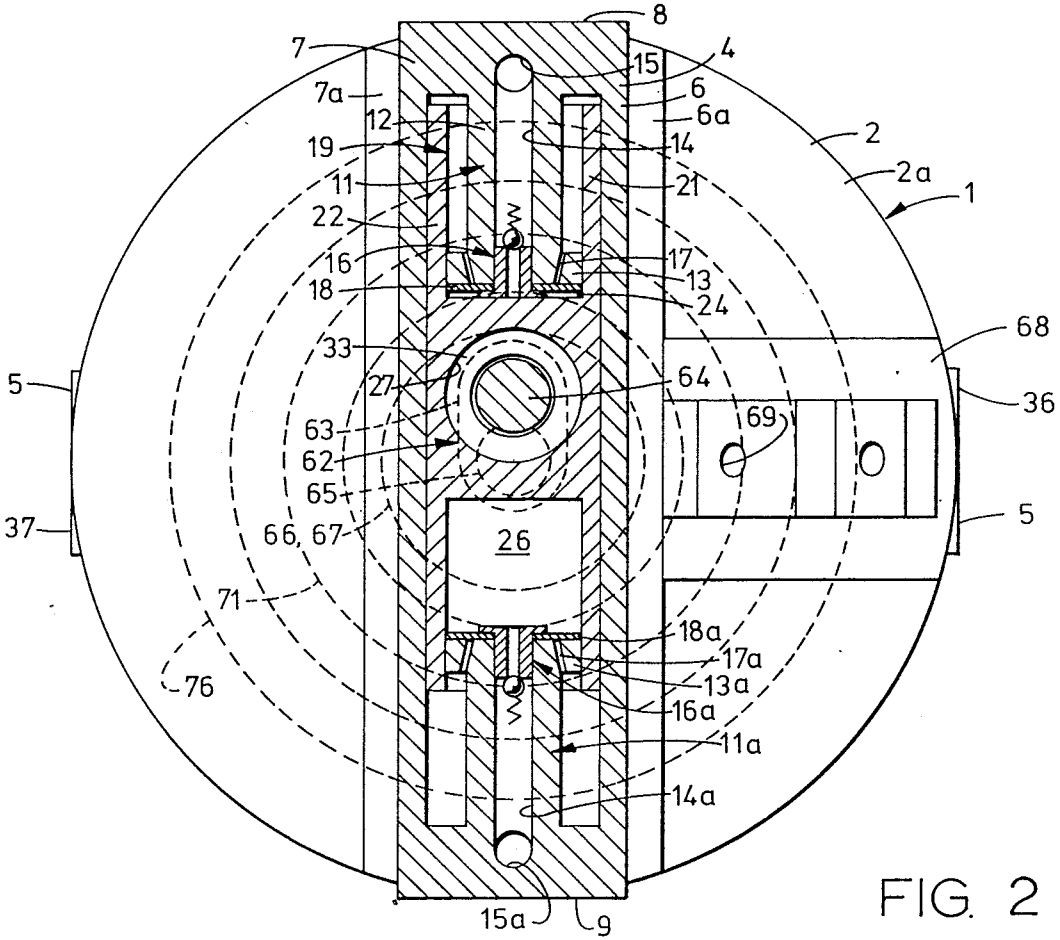
FIG. 2 is a plan view, partly in cross-section, of the compressor of the present invention.
Figure 3:
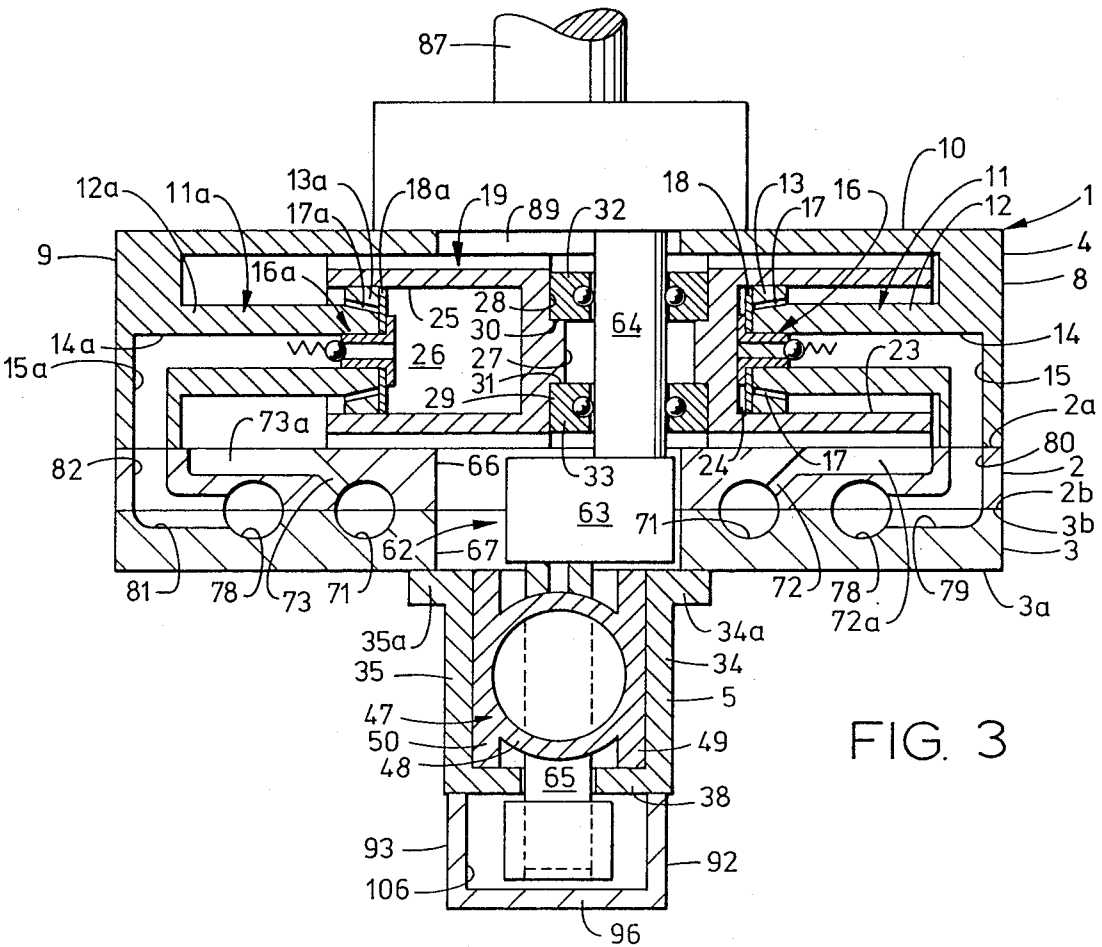
FIG. 3 is a fragmentary cross-sectional view of the compressor of the present invention, taken along the center line of the first cylinder housing.

Turning to FIGS. 2 and 3, the end wall 8 of first cylinder housing 4 supports a piston rod/piston head assembly generally indicated at 11. The assembly 11 comprises a piston rod 12, and a piston head 13. The piston head 13 may constitute an integral, one-piece part of piston rod 12, if desired. The assembly 11 is supported by end wall 8 and extends axially of the first cylinder housing 4. The piston rod 12 may be affixed to end wall 8, or it may constitute an integral, one-piece part thereof. In any event, it will be apparent that the piston rod/piston head assembly 11 is fixed in position. The assembly 11 has an axial bore 14 extending therethrough and communicating with a bore 15 formed in end wall 8. The purpose of bores 14 and 15 will be apparent hereinafter. At the forward end of piston head 13, a ball valve is provided. The ball valve is schematically illustrated and generally indicated at 16. The piston head 13, near its periphery, is provided with one or more passages 17, the one or more passages 17 are normally closed by a flap valve 18, held in place by a flange of the ball valve 16. The purpose of the one or more passages 17 and the flap valve 18 will be apparent hereinafter.

The end wall 9 of the first cylinder housing 10 supports a second piston rod/piston head assembly. This piston rod/piston head assembly is substantially identical to the assembly 11 and like parts have been given like index numerals, followed by "a". As is aPParent from FIGS. 2 and 3, the assembly 11*a* is also fixed in position; is opposed to assembly 11; and is coaxial therewith.

The first cylinder housing 4 also contains a sleeve, generally indicated at 19. As is most clearly shown in FIG. 1, sleeve 19 comprises an elongated member having a cylindrical central portion 20 flanked by planar side wall portions 21 and 22.

That end of sleeve 19 nearest cylinder housing end wall 8 is provided with an axial bore 23 adapted to contain piston head 13. Piston head 13 makes a fluid-tight seal with the interior surface of sleeve 19 defining bore 23. This seal may be accomplished in any well known manner including the use of a sealing ring (not shown). That portion of bore 23 forward of piston head 13 and the forward end of piston head 13, itself, define a compression chamber 24. In similar fashion, that end of sleeve 19 nearest cylinder housing end wall 9 has an axial bore 25 formed therein adapted to receive piston head 13*a* in fluid-tight, sealing relationship. That portion of bore 25 ahead of piston head 13*a*, together with the forward end of piston head 13*a* define a compression chamber 26.

The sleeve 19 is completed by a transverse bore 27 having end portions 28 and 29 of slightly larger diameter. These diameter changes form annular shoulders 30 and 31. Annular shoulders 30 and 31 support bearing means 32 and 33, respectively. The purpose of bearing means 32 and 33 will be apparent hereinafter. As will also be apparent hereinafter, the sleeve 19 is adapted to reciprocate within first cylinder chamber 4.

Turning now to FIGS. 1 and 3, the second cylinder housing 5 is substantially identical to the first cylinder housing 4, having longitudinal side walls 34 and 35, end walls 36 and 37, and an outer wall 38. The longitudinal side walls 34 and 35 may be provided with laterally extending flanges 34*a* and 35*a* and the second cylinder housing 5 is affixed to the outer surface 3*a* of manifold plate 3 in any appropriate fluid-tight manner, as in the case of the mounting of first cylinder housing 4. As will be apparent from the Figures, and particularly FIG. 2, the second cylinder housing extends diametrically of the outer surface 3*a* of manifold plate 3 and its long axis is oriented at ninety degrees to the long axis of first cylinder housing 4.

As is most clearly shown in FIG. 1, the end 36 of second cylinder housing 5 supports a piston rod/piston head assembly generally indicated at 39. The assembly 39 is substantially identical to the assembly 11 of FIG. 3. To this end, the assembly 39 comprises a piston rod 40 and a piston head 41. The assembly 39 has an axial bore 42 leading to a bore 43 formed in end wall 36 of the second cylinder housing 5. The bore 42, at the piston head end, is provided with a ball valve schematically indicated at 44. The piston head 41, near its periphery, is provided with one or more passages 45 extending therethrough. The one or more passages 45 are normally closed by a flap valve 46 held in place by a flanged portion of the ball valve assembly 44. Again, the piston rod/piston head assembly 39 may be affixed to the end wall 36 of the second cylinder housing 5 in any appropriate manner, or it may constitute an integral, one-piece part thereof.

The end wall 37 of the second cylinder housing 5 supports a piston rod/piston head assembly identical to assembly 39. As a consequence, like parts have been given like index numerals followed by "a". The piston rod/piston head assemblies 39 and 39*a* are fixed in their positions; are opposed to each other; and are coaxial.

The second cylinder housing 5 is provided with a sleeve generally indicated at 47. The sleeve 47 is substantially identical to the sleeve 19 of the first cylinder housing 4. As is best shown in FIG. 3, the sleeve 47 has a central cylindrical portion 48 and planar side portions 49 and 50.

Returning to FIG. 1, that end of sleeve 47 nearest the end wall 36 of the second cylinder housing 5 is provided with a bore 51 adapted to receive piston head 41 with a sealing engagement therebetween. Again, this sealing engagement may be accomplished by way of a sealing ring, or the like (not shown). That portion of bore 51 ahead of piston head 41, together with the forward portion of piston head 41, define a compression chamber. The sleeve 47, has a similar axial bore 53 formed in that end thereof nearest the end wall 37 of the second cylinder housing 5. The bore 53, receives piston head 41*a* with a sealing engagement therebetween. That portion of bore 53, ahead of piston head 41*a*, together with the forward portion of piston head 41*a*, define a compression chamber 54.

Between bores 51 and 53, the sleeve 47 has a transverse bore 55 within enlarged portions 56 and 57. The enlarged portions form annular shoulders 58 and 59 which support bearing means 60 and 61. The purpose of bearing means 60 and 61 will be apparent hereinafter. As in the case of sleeve 19, the sleeve 47 is adapted to reciprocate within the second cylinder housing 5.

The comPressor 1 of the present invention is provided with a crankshaft generally indicated at 62. The crankshaft 62 comprises a crank element 63 carrying near its ends oppositely directed first and second crank pins 64 and 65. It will be apparent from the drawings, and particularly FIG. 3, that the first crank pin is journaled in the bearings 32 and 33 of sleeve 19. Similarly, the second crank pin 65 is journaled in the bearings 60 and 61 of sleeve 47 (see FIG. 1). The crank element 63 is located in coaxial and coextensive holes 66 and 67 formed in manifold plates 2 and 3, respectively. The holes 66 and 67 are of such size as to enable the crank element 63 to perform its eccentric rotary motion illustrated in FIGS. 4A through 4H, as will be described hereinafter.

As is shown in FIG. 1, an inlet/outlet fitting 68 is affixed to the exterior surface 2*a* of manifold plate 2 in fluid-tight fashion. If the inlet/outlet fitting 68 and the manifold plate 2 are made of plastic material, the fluid-tight mounting may be accomplished by gluing or the like. If the inlet/outlet fitting 68 and the manifold plate 2 are made of metal, the fluid-tight mounting may be accomplished by bolts and appropriate gasketing (not shown), welding, or any other appropriate and well-known means.

The inlet/outlet fitting 68 has an inlet passage 69. Inlet passage 69 may take in ambient air in an open system. In a closed system, inlet passage 69 will take in gas to be pressurized from the low pressure side of the enclosed system. The inlet passage 69 is connected to a passage 70 formed in manifold plate 2. The passage 70, in turn, leads to an annular passage 71 formed in the abutting surfaces 2*b* and 3*b of* manifold plates 2 and 3, respectively (see also FIG. 2). The annular passage 71 is connected to the interior of the first cylinder housing 4, preferably behind piston heads 13 and 13*a* by passages 72 and 73 and slots 72*a* and 73*a* formed in manifold plate 2 (see FIG. 3). The annular passage 71 is similarly connected to the interior of the second cylinder housing 5 by passages 74 and 75 and slots 74*a* and 75*a* formed in manifold plate 3 (see FIG. 1).

The inlet/outlet fitting 68 is provided with an outlet passage 76. The outlet passage 76, for pressurized or compressed gas or fluid, may be connected directly to a compressed air actuated tool such as a spray gun or the like. The outlet passage 76 may also be connected to a holding tank, or to the pressure side of a closed system such as an air conditioning or refrigeration system, or the like. The outlet passage, 76 is connected by a passage 77 formed in manifold plate 2 to an annular passage 78 formed in the surfaces 2*b* and 3*b* of manifold plates 2 and 3, respectively (see also FIG. 2). The annular passage 78 is connected by passage 79 (formed in the abutting surfaces 2*b* and 3*b* of manifold plates 2 and 3), and by passage 80 formed in manifold plate 2, to the passage 15 of the first cylinder housing 4. Similarly, the passage 78 is connected by passage 81 (formed in the abutting faces 2*b* and 3*b* of manifold Plates 2 and 3, respectively, and by passage 82 formed in manifold plate 2), to the passage 15*a* of the first cylinder housing 4. This is clearly shown in FIG. 3. As is shown in FIG. 1, the annular passage 78 is connected by passage 83 (formed in the abutting surfaces 2*b* and 3*b* of manifold plates 2 and 3) and by passage 84 (formed in manifold plate 3) to the passage 43 of the second cylinder housing 5. In similar fashion, the annular passage 78 is connected by passage 85 (formed in the abutting surfaces 2*b* and 3*b* of manifold plates 2 and 3) and by passage 86 (formed in manifold plate 3) to the passage 43*a* of the second cylinder housing 5.

Reference is again made to FIG. 3. The sleeve 19 is illustrated in its position furthest to the right in the first cylinder housing 4, as viewed in FIG. 3. It will be remembered that sleeves 19 and 47 are intended to reciprocate in their respective cylinder housings 4 and 5. In FIG. 3, it can be considered that the sleeve 19 has completed its shifting to the right (as viewed in FIG. 3) and therefore has completed a compression stroke with respect to compression chamber 24 and an intake stroke with respect to compression chamber 26. Continued rotation of the crank 62 will cause sleeve 19 to shift to the left as viewed in FIG. 3. The shifting of sleeve 19 to the left will cause compression chamber 24 to enlarge, creating a vacuum therein. Flap valve 18 will open permitting ambient air or low pressure gas from inlet passage 69 of inlet/outlet fitting 68 to enter compression chamber 24 via the one or more ports 13. Air from passage 14 cannot enter the compression chamber 24 by virtue of ball valve 16. Thus, sleeve 19 is executing an intake stroke with respect to compression chamber 24. As illustrated in FIG. 3 the sleeve 19 has just completed an intake stroke with respect to compression chamber 26, and the chamber is therefore filled with air or gas. When sleeve 19 moves to the left as viewed in FIG. 3, it will execute a compression stroke with respect to compression chamber 26. The compressed air within chamber 26 cannot exit the chamber via the one or more passages 17*a*, , by virtue of flap valve 18*a*. The compressed air or gas, on the other hand, can exit chamber 26 through ball valve 16*a* and via passages 14*a*, 15*a*, 82, 81, 78 and 77 to the outlet passage 76 of inlet/outlet fitting 68. When the sleeve 19 has shifted its maximum distance to the left, as viewed in FIG. 3, sleeve 19 will have completed an intake stroke with respect to chamber 24 and a compression stroke with respect to chamber 26. Continued rotation of crank 62 will cause the sleeve 19 to shift again to the right, executing a compression stroke with respect to chamber 24 and an intake stroke with respect to chamber 26. Assuming that crank 62 starts its revolution from the position shown in FIG. 3, during the first half revolution, sleeve 19 will execute an intake stroke with respect to chamber 24 and simultaneously will execute a compression stroke with respect to chamber 26. During the second half of a complete revolution of crank 62, the sleeve 19 will execute a compression stroke with respect to chamber 24 and simultaneously will execute an intake stroke with respect to chamber 26. It will be understood that as crank 62 rotates, the sleeve 47 of the second cylinder chamber 5, and its compression chambers 52 and 54, will operate in the same manner to produce alternate compression and intake strokes with respect to each of the chambers 52 and 54.

Figure 4A:
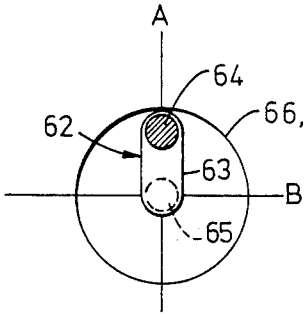
FIGS. 4A through 4H illustrate the motion of the crank of the compressor of the present invention during one complete revolution.
Figure 4B:
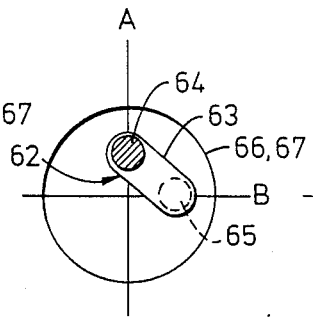

Reference is now made to FIGS. 4A through 4H wherein the motion of the crank 62 is diagramatically illustrated to show how its eccentric rotation imparts reciprocation to sleeves 19 and 47. In each of FIGS. 4A through 4H the holes 66 and 67 in manifold plates 2 and 3 are shown, together with crank 62, crank element 63, first crank pin 64 and second crank pin 65. In each of these figures, the line designated "A" represents the longitudinal axis of the first cylinder housing 4, which is coaxial with the longitudinal axes of sleeve 19 and piston rod/piston head assemblies 11 and 11*a*. Similarly, in each of the figures the line designated "B" represents the longitudinal axis of the second cylinder housing 5, which is coaxial with the longitudinal axes of sleeve 47 and piston rod/piston head assemblies 39 and 39*a*. With the crank 62 in the position shown in FIG. 4A sleeve 19 is in the position shown in FIGS. 2 and 3, and the sleeve 47 is in the position shown in FIG. 1. In FIG. 4A the first crank pin 64 is in position for sleeve 19 to initiate an intake stroke with respect to chamber 24 and a compression stroke with respect to chamber 26. Simultaneously, the second crank pin 65 is in such position that sleeve 47 has completed one-half of a compression stroke with respect to chamber 52 and one-half of an intake stroke with respect to chamber 54.

As the crank 62 begins to rotate, sleeve 19 will begin to shift to the left as viewed in FIG. 3, and sleeve 47 will shift to the right as viewed in FIG. 1. When cranks 64 and 65 reach the positions shown in FIG. 4B, sleeve 19 will have completed the first quarter of its intake stroke with respect to chamber 24 and the first quarter of its compression stroke with respect to chamber 26. Simultaneously, sleeve 47 will have completed three quarters of its compression stroke with respect to chamber 52 and three quarters of its intake stroke with respect to chamber 54.

Figure 4C:
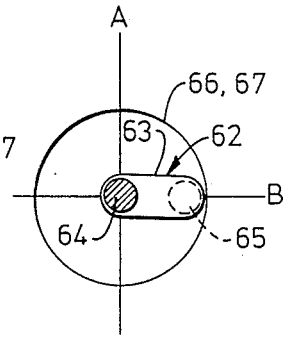

When crank pins 64 and 65 reach the positions shown in FIG. 4C, sleeve 19 will be centered with respect to the first cylinder housing 4, having completed one-half its intake stroke with respect to chamber 24 and one-half its compression stroke with respect to chamber 26. Simultaneously, sleeve 47 will have shifted all the way to the right in the second cylinder housing 5, as viewed in FIG. 1, thereby completing the compression stroke with respect to chamber 52 and completing the intake stroke with respect to chamber 54.

Figure 4D:
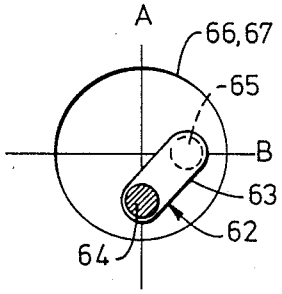

Continued eccentric rotation of crank 62 will cause crank pins 64 and 65 to reach the positions shown in FIG. 4D. Under these circumstances, the sleeve 19 continues to shift to the left as viewed in FIG. 3, having completed three quarters of its intake stroke with respect to chamber 24 and three quarters of its compression stroke with respect to chamber 26. At the same time, sleeve 47 has begun to shift to the left as viewed in FIG. 1, having completed the first quarter of its intake stroke with respect to chamber 52 and the first quarter of its compression stroke with respect to chamber 54.

Figure 4E:
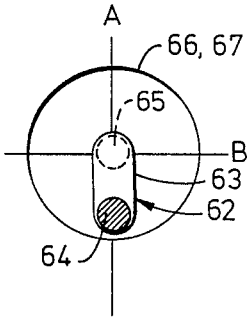
Figure 4F:
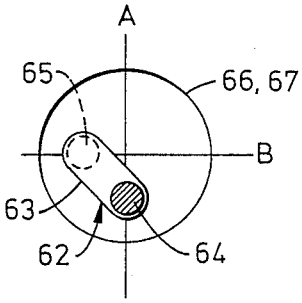

In FIG. 4E, crank pins 64 and 65 have reached the positions wherein sleeve 19 has shifted all the way to the left as viewed in FIG. 3, completing its intake stroke with respect to chamber 24 and its compression stroke with respect to chamber 26. Simultaneously, sleeve 47 is centered with respect to second cylinder housing 5, having completed one-half its intake stroke with respect to chamber 52 and one-half its compression stroke with respect to chamber 54.

When the crank pins 64 and 65 reach the positions shown in 4F, sleeve 19 will have shifted to the right as viewed in FIG. 3, completing the first quarter of its compression stroke with respect to chamber 24 and one quarter of its intake stroke with respect to chamber 26. At the same time, sleeve 47 continues to shift to the left as viewed in FIG. 1, having completed three quarters of its intake stroke with respect to chamber 52 and three quarters of its compression stroke with respect to chamber 54.

Figure 4G:
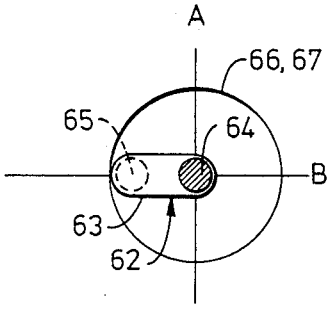

Continued eccentric rotation of crank 62 will bring the crank pins 64 and 65 to the positions shown in FIG. 4G. In this figure, sleeve 19 has reached its halfway point in its travel to the right as viewed in FIG. 3, completing one-half the compression stroke with respect to chamber 24 and one-half the intake stroke with respect to chamber 26. At the same time, sleeve 47 has shifted all the way to the left as viewed in FIG. 1, completing its intake stroke with respect to chamber 52 and its compression stroke with respect to chamber 54. When the crank pins 64 and 65 attain the positions shown in FIG. 4H, sleeve 19 continues its movement to the right as viewed in FIG. 3, having completed three quarters of its compression stroke with respect to chamber 24 and three quarters of its intake stroke with respect to chamber 26. At the same time, sleeve 47 will have initiated movement to the right as viewed in FIG. 1, having completed one quarter of its compression stroke with respect to chamber 52 and one quarter of its intake stroke with respect to chamber 54.

Figure 4H:
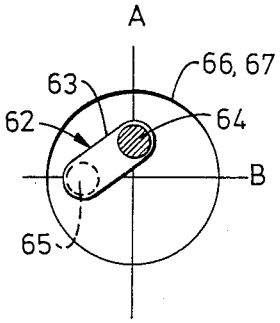

From the positions shown in FIG. 4H, the crank pins 64 and 65 return to the positions shown in FIG. 4A. When this is accomplished, the sleeve 19 will have shifted all the way to the right as viewed in FIG. 3, completing its compression stroke with respect to chamber 24 and its intake stroke with respect to chamber 26. At the same time, sleeve 47 in its movement to the right as viewed in FIG. 1, will have achieved its central position as shown in that Figure, having completed one-half its compression stroke with respect to chamber 52 and one-half its intake stroke with respect to chamber 54.

In the single eccentric revolution of crank 62, illustrated in FIGS. 4A through 4H, it will be noted that each sleeve executes a compression stroke and an intake stroke with respect to each of its respective compression chambers. Thus, in FIG. 4C, a compression stroke is completed with respect to chamber 52 and an intake stroke is completed with respect to chamber 54. In FIG. 4E, a compression stroke is completed with respect to chamber 26 and an intake stroke is completed with respect to chamber 24. In FIG. 4G, a compression stroke is completed with respect to chamber 54 and an intake stroke is completed with respect to chamber 52. Finally, in FIG. 4A, a compression stroke is completed with respect to chamber 24 and an intake stroke is completed with respect to chamber 26. It is to be noted that as the crank 62 turns in a counter clockwise direction (FIGS. 4A–4H), the sequence of compression strokes is clockwise.

In the sequence illustrated by FIGS. 4A through 4H and back to 4A, it should be noted that crank pin 64 makes one complete revolution about its own axis. Similarly, crank pin 65 makes one revolution about its own axis. This axial rotation of crank pin 64 and crank pin 65 is accommodated by the bearings 32 and 33, and the bearings 60 and 61, respectively, of sleeves 19 and 47. Simultaneously, during this sequence, crank pin 64 shifts rectilinearly along the axis A of cylinder housing 4 and crank pin 65 shifts rectilinearly along the central axis B of cylinder housing 5. The rectilinear shifting of crank pins 64 and 65 result in the reciprocating movement of sleeves 19 and 47, described above.

In order for the compressor 1 of the present invention to function as described, it is necessary to drive the crank 62 to produce its eccentric rotation as illustrated in FIGS. 4A through 4H. To this end, an axially rotating drive shaft 87 is provided (see FIGS. 1 and 3). The drive shaft 87 may constitute the drive shaft of a prime mover such as an electric motor, an internal combustion engine, or the like. Alternatively, drive shaft 87 may constitute a separate driven shaft connected to the drive shaft of a prime mover by belt and pulley means, gear means, or the like (not shown). The nature of the prime mover and the manner in which it is coupled to shaft 87 does not constitute a limitation of the present invention. For this reason, a prime mover is diagaramatically indicated in FIG. 1 at 88.

It will be noted from FIGS. 1 and 3 that the exterior wall 10 of the first cylinder housing 4 has formed therein an elongated slot 89. The slot 89 extends centrally and longitudinally of outer wall 10. The upper end of crank pin 64 of crank 62 extends through the slot. It will be understood that slot 89 is so sized as to accommodate the rectilinear movement of crank pin 64, described with respect to FIGS. 4A through 4H.

The drive shaft 87 is connected to the upper end of crank pin 64 through a power transfer assembly diagramatically indicated at 90. The purpose of the power transfer assembly 90 is to convert the rotary movement of drive shaft 87 to the rotating and rectilinear reciprocating motion of crank pin 64. The nature of the power transfer assembly 90 does not constitute a limitation of the present invention. Prior art workers have devised numerous systems for this purpose. For example, a radial system can be used. Alternatively, the power transfer assembly described in the above mentioned U.S. Pat. No. 4,788,944 could also be employed. For this reason, teachings of that patent are incorporated herein by reference. Briefly, in accordance with the teachings of U.S. Pat. No. 4,788,944, the drive shaft 87 would be connected to a flywheel. The crank pin 64 would be provided at its uppermost end with a crank element similar to crank element 63. That surface of this upper crank element which faces the flywheel would support a pair of rollers located near each end of the upper crank element. The rollers, in turn, would be located in a longitudinal slot formed in a tangent bar extending across the flywheel with one of its ends pivotally attached thereto. Such a system is exemplary only of a number of well known prior art systems which could be used for this purpose.

Depending upon the materials from which the parts of compressor 1 are made, and the nature of bearings 32, 33, 60 and 61, the compressor may or may not require internal circulation of lubricating oil. Porous bronze bearings, for example, would not require a circulating lubrication system.

FIGS. 1 and 3 illustrate a lubrication circulation system for the compressor 1, for use in instances where such a system is required or desired. To this end, a pump housing 91 is mounted on the exterior wall 38 of the second cylinder housing 5. The pump housing comprises longitudinal side walls 92 and 93 (see FIG. 3), and end walls 94 and 95 (see FIG. 1) together with an outside wall 96. The pump housing 91 is affixed to the second cylinder housing 5 in fluid-tight fashion by any appropriate means. For example, if the second cylinder housing 5 and the pump housing 91 are made of plastic material, they may be glued together. If both of these elements are made of metal or the like, the pump housing may be brazed or bolted to the cylinder housing 5. Where bolts are used, appropriate gasket means should also be employed.

The outside wall 38 of second cylinder housing 5 has an elongated, longitudinally extending slot formed therein, similar to slot 89 formed in the outside wall 10 of first cylinder housing 4. As will be apparent from FIGS. 1 and 3, crank pin 65 extends through slot 97. Slot 97 will accommodate the rectilinear reciprocating movement of crank pin 65.

Crank pin 65 has an axial bore 98 which communicates with a longitudinal bore 99 in crank element 63. Crank pin 64 may also have an axial bore communicating with the crank element bore 99. Various transverse outlet bores, if desired, may be provided in crank pins 64 and 65 by which lubricating oil can be directed to various internal areas of the compressor 1.

The axial bore 98 of crank pin 65 terminates in a transverse slot 100 which intersects axial bore 98.

A pump element is shown at 101. Pump element 101 comprises a rod-like portion 102 terminating at one end in an enlarged head portion 103. The rod-like portion 102 has an axial bore 104 formed therein. The head portion 103 has a transverse bore 105 formed therein. The bores 104 and 105 intersect. The bore 105 is of such diameter as to rotatively receive the free end of crank pin 65. The pump housing 91 has an elongated chamber 106 to accommodate reciprocating movement of the free end of crank pin 65 and the head portion 103 of pump element 101. The pump housing 91 has a longitudinal bore 107 communicating with the chamber 106. The longitudinal bore 107 is adapted to slidably receive the rod-like portion 102 of pump element 101. The rod-like portion 102 may be provided with one or more sealing rings to make a fluid-tight seal with the interior surface of bore 107.

Bore 107 is provided with a passage 108 formed in Pump housing 91 which communicates with a passage 109 formed in the second cylinder housing 5. The passage 109, in turn, communicates with the interior of the second cylinder housing 105. Finally, a one-way valve, generally indicated at 110, is provided at the juncture of bores 107 and 108.

From the above description it will be apparent that as the pump element 101 is shifted to the right (as viewed in FIG. 1) by crank pin 65, a vacuum will be formed in bore 107, opening the one-way valve 110 and causing oil from the second cylinder housing 5 to enter the bore 107 via passages 109 and 108. At the same time, rotation of crank pin 65 causes the crank pin slot 100 to shift out of communication with the pump element bore 104. Once crank element 65 has shifted to its right-hand most position as seen in FIG. 1, it will begin to shift to the left, as viewed in that Figure. This will cause the crank slot 100 to realign with the pump element bore 104. Furthermore, the one-way valve 110 will close and oil from bore 107 will be pumped via passages 104 and 98 to the necessary internal areas of the compressor 1.

Modifications may be made in the invention without departing from the spirit of it.

What is claimed is:

1. A compressor comprising first and second manifold plates having inner and outer surfaces, said manifold plates being joined together with their inner surfaces abutting in fluid tight fashion, first and second elongated cylinder housings each having side walls, end walls and an outer wall, said first and second cylinder housings being affixed in fluid tight fashion to the outer surfaces of said first and second manifold plates, respectively, and extending thereacross in directions oriented at 90° with respect to each other, first and second piston head/piston rod assemblies located in each of said cylinder housings, said first and second piston head/piston rod assemblies of each cylinder housing extending axially thereof from the cylinder housing ends in fixed and opposed relationship, first and second elongated sleeves located within said first and second cylinder housings, respectively, and being axially shiftable therein, each of said sleeves having an axial bore at each of its ends, each said axial bore receiving in fluid tight fashion one of said piston heads of its respective cylinder housing and forming a compression chamber therewith providing two compression chambers per cylinder housing, a crank comprising a crank element located in a central hole in said manifold plates and a pair of oppositely directed first and second crank pins each mounted on bearings in a central transverse hole in one of said sleeves located between said sleeve bores, means to impart rotation to said crank, said crank and its pins interconnecting said sleeves such that as said crank is rotated each crank pin rotates about its own axis and simultaneously reciprocates rectilinearly resulting in reciprocation of its respective sleeve within its respective cylinder housing providing an intake stroke and a compression stroke in sequence for each said four compression chambers, an intake port and an outlet port for said compressor, means to introduce fluid from said inlet port to each compression chamber during its intake stroke and means to deliver pressurized fluid from each compression chamber during its compression stroke to said outlet port.

2. The compressor claimed in claim 1 wherein said means to impart rotation to said crank comprises a driven power shaft and a power transfer assembly connecting said power shaft to said first crank pin.

3. The compressor claimed in claim 2 wherein said means to introduce fluid from said inlet port to each compression chamber comprises a series of passages in said manifold plates connecting said inlet port to each end of each cylinder housing behind the piston head of the adjacent one of said piston head/piston rod assemblies, and at least one one-way valve located in the peripheral portion of each of said piston heads, and said means to deliver pressurized air from each compression chamber to said outlet port comprises axial passages formed in each of said piston head/piston rod assemblies and connecting passages in said manifold plates leading from each of said compression chambers to said outlet port and a one-way valve in the center of each of said piston heads for the adjacent axial passage.

4. The compressor claimed in claim 3 wherein said manifold plates, said cylinder housings, said piston head/piston rod assemblies and said sleeves are molded of plastic material.

5. The compressor claimed in claim 3 including an axial passage formed in said second crank pin, said axial passage having one end leading to at least one outlet passage in said crank, said axial passage having another end leading to a transverse slot formed in the free end of said second crank pin, a pump housing mounted on said outer wall of that one of said cylinder housings into which said second crank pin extends, said free end of said crank pin extending through a longitudinal slot in said outer wall and into said pump housing, a pump piston rotatably mounted on said free end of said second crank pin, said pump piston being reciprocable by said crank in a bore formed in said pump housing, sealing means on said pump piston engaging said pump housing bore, said pump Piston having an axial bore aligned at one end with said transverse slot in said second crank pin and communicating at its other end with said pump housing bore, said pump housing bore being connected to the interior of said last mentioned cylinder housing through a one-way valve permitting flow to said pump housing bore whereby rotation of said crank will cause circulation of oil within said compressor by said pump piston.

6. The compressor claimed in claim 1 wherein said means to introduce fluid from said inlet port to each compression chamber comprises a series of passages in said manifold plates connecting said inlet port to each end of each cylinder housing behind the piston head of the adjacent one of said piston head/piston rod assemblies, and at least one one-way valve located in the peripheral portion of each of said piston heads, and said means to deliver pressurized air from each compression chamber to said outlet port comprises axial passages formed in each of said piston head/piston rod assemblies and connecting passages in said manifold plates leading from each of said compression chambers to said outlet port and a one-way valve in the center of each of said piston heads for the adjacent axial passage.

7. The compressor claimed in claim 1 wherein said manifold plates, said cylinder housings, said piston head/piston rod assemblies and said sleeves are molded of plastic material.

8. The compressor claimed in claim 1 including an axial passage formed in said second crank pin, said axial passage having one end leading to at least one outlet passage in said crank, said axial passage having another end leading to a transverse slot formed in the free end of said second crank pin, a pump housing mounted on said outer wall of that one of said cylinder housings into which said second crank pin extends, said free end of said second crank pin extending through a longitudinal slot in said outer wall and into said pump housing, a pump piston rotatably mounted on said free end of said second crank pin, said pump piston being reciprocable by said crank in a bore formed in said pump housing, sealing means on said pump piston engaging said pump housing bore, said pump piston having an axial bore aligned at one end with said transverse slot in said second crank pin and communicating at its other end with said pump housing bore, said pump housing bore being connected to the interior of said last mentioned cylinder housing through a one-way valve permitting flow to said pump housing bore whereby rotation of said crank will cause circulation of oil within said compressor by said pump piston.

* * * * *